US007373685B2

(12) United States Patent
Nam

(10) Patent No.: US 7,373,685 B2
(45) Date of Patent: May 20, 2008

(54) MECHANICAL SWEEPER CONFIGURATION

(76) Inventor: Peter Ho Ka Nam, 1001B, 10/F, Sunbeam Centre, 27 Shing Yip Street, Kwun Tong, Kowloon (HK)

( * ) Notice: Subject to any disclaimer, the term of this patent is extended or adjusted under 35 U.S.C. 154(b) by 524 days.

(21) Appl. No.: 10/644,181

(22) Filed: Aug. 20, 2003

(65) Prior Publication Data

US 2005/0039277 A1 Feb. 24, 2005

(51) Int. Cl.
*A47L 11/33* (2006.01)

(52) U.S. Cl. ..... 15/41.1; 15/87; 15/49.1; 15/79.1

(58) Field of Classification Search ..... 15/79.1, 15/41.1, 49.1, 79.2, 87, 82–83, 52.1, 78
See application file for complete search history.

(56) References Cited

U.S. PATENT DOCUMENTS 488,950 A 12/1892 Raymond
563,869 A 7/1896 Mueller
1,507,417 A 9/1924 Orr
2,268,059 A * 12/1941 Parker et al. ..... 15/83
2,670,485 A * 3/1954 Gomez ..... 15/52.1
3,937,174 A 2/1976 Haaga ..... 15/42
4,484,371 A * 11/1984 Patzold et al. ..... 15/41.1
4,502,173 A * 3/1985 P/a/tzold et al. ..... 15/41.1
4,644,605 A * 2/1987 Joss et al. ..... 15/329
5,184,367 A * 2/1993 Haaga ..... 15/49.1
5,231,724 A 8/1993 Haaga ..... 15/41.1
5,896,611 A 4/1999 Haaga ..... 15/42

* cited by examiner

*Primary Examiner*—Shay L Karls

(57) ABSTRACT

A mechanical sweeper is disclosed. The mechanical sweeper includes a front housing and a rotating brush secured to the front housing having tangentially extending bristles adapted to engage a surface at an oblique angle. The mechanical sweeper further includes a frame secured to a lower portion of the front housing and a height adjustment column rising from the rear of the frame. The mechanical sweeper still further includes dirt receptacle removably positional on an upper surface of the frame. The front housing and column serve to orient the dirt receptacle in a position relative to the frame.

20 Claims, 5 Drawing Sheets

MECHANICAL SWEEPER CONFIGURATION

TECHNICAL FIELD

Generally, this invention relates to mechanical sweepers. In particular, this invention relates to a configuration of a mechanical sweeper.

BACKGROUND OF THE INVENTION

Mechanical sweepers are well know in the arts. Typically, these sweepers employ one or more vertical axis brushes which extend outwardly from the sweeper. Dirt is swept up by the brushes into a scoop which deposits the dirt and debris in a dirt receptacle. One type of sweeper, disclosed in U.S. Pat. No. 3,937,174, now expired, uses a pair of vertical axis brushes driven by a worm gear arrangement. This arrangement allows the brushes to sweep debris into a dirt receptacle during a forward stroke. On the reverse stroke, the worm gear wheel pivots around a drive shaft such that rearward movement of the sweeper also causes dirt and debris to be swept into a dirt receptacle during the reverse stroke.

Because such devices can be used both outdoors and indoors, the sweeper may encounter a variety of surface types. Therefore, it is desirable to adjust the force that the brushes apply to the surface being cleaned. For example, on rough surfaces, it is desirable to engage the brushes with less force to reduce pushing effort, whereas on smooth surfaces it is desirable to engage the surface with more force to get better debris pickup. Prior designs have addressed this problem by adjusting the height of the wheels that drive the sweeper brushes. A drawback to these designs is that the brushes are located on the front of the sweeper and the operator is positioned behind the sweeper. Thus, the operator must-move around the sweeper to make an adjustment for different surface types.

In addition, these cleaners typically include a dirt receptacle for transporting recovered dirt to a trash container. In some cleaners, the dirt receptacle includes the rear wheel of the cleaner. A drawback to this design is that removal of the receptacle prevents movement of the remainder of the sweeper. In addition, such receptacles are difficult to re-align with the sweeping portion of the sweeper after the dirt receptacle has been emptied.

What is needed therefore, is a mechanical sweeper configuration that overcomes the above-mentioned drawbacks.

SUMMARY OF THE INVENTION

In accordance with a first aspect of the present invention, there is provided a mechanical sweeper. The mechanical sweeper includes a front housing and a rotating brush secured to the front housing having tangentially extending bristles adapted to engage a surface at an oblique angle. The mechanical sweeper further includes a frame secured to a lower portion of the front housing and a height adjustment column rising from the rear of the frame. The mechanical sweeper still further includes dirt receptacle removably positional on an upper surface of the frame. The front housing and column serve to orient the dirt receptacle in a position relative to the frame.

In accordance with a second aspect of the present invention, there is provided a mechanical sweeper. The mechanical sweeper includes a front housing and a first and a second rotating brush secured to the front housing each having tangentially extending bristles adapted to engage a surface at an oblique angle. The mechanical sweeper further includes a dirt scoop positioned in the upper housing proximate to the point at the bristles of the first brush contact the bristles of the second brush. The mechanical sweeper still further includes a frame secured to a lower portion of the front housing and a height adjustment column rising from the rear of the frame. The mechanical sweeper yet further includes a dirt receptacle removably positional on an upper surface of the frame and adapted to receive dirt from the dirt scoop when placed in an operational position. The front housing and column serve to orient the dirt receptacle in the operational position.

DETAILED DESCRIPTION

Figure 1:
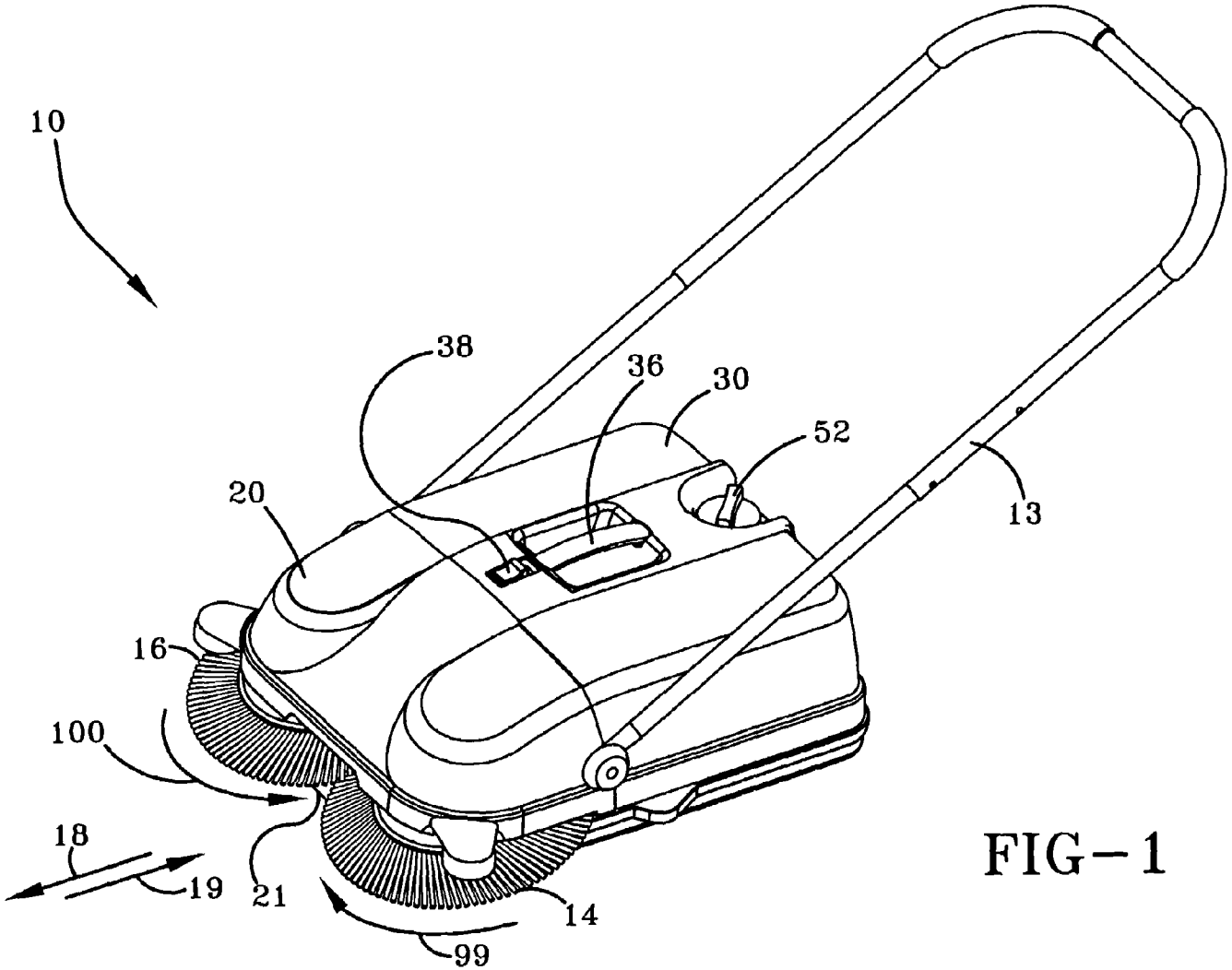
FIG. 1 is a perspective view of a mechanical sweeper, which incorporates the features of the present invention therein.

While the invention is susceptible to various modifications and alternative forms, a specific embodiment thereof has been shown by way of example in the drawings and will herein be described in detail. It should be understood, however, that there is no intent to limit the invention to the particular form disclosed, but on the contrary, the intention is to cover all modifications, equivalents, and alternatives falling within the spirit and scope of the invention as defined by the appended claims.

Figure 2:
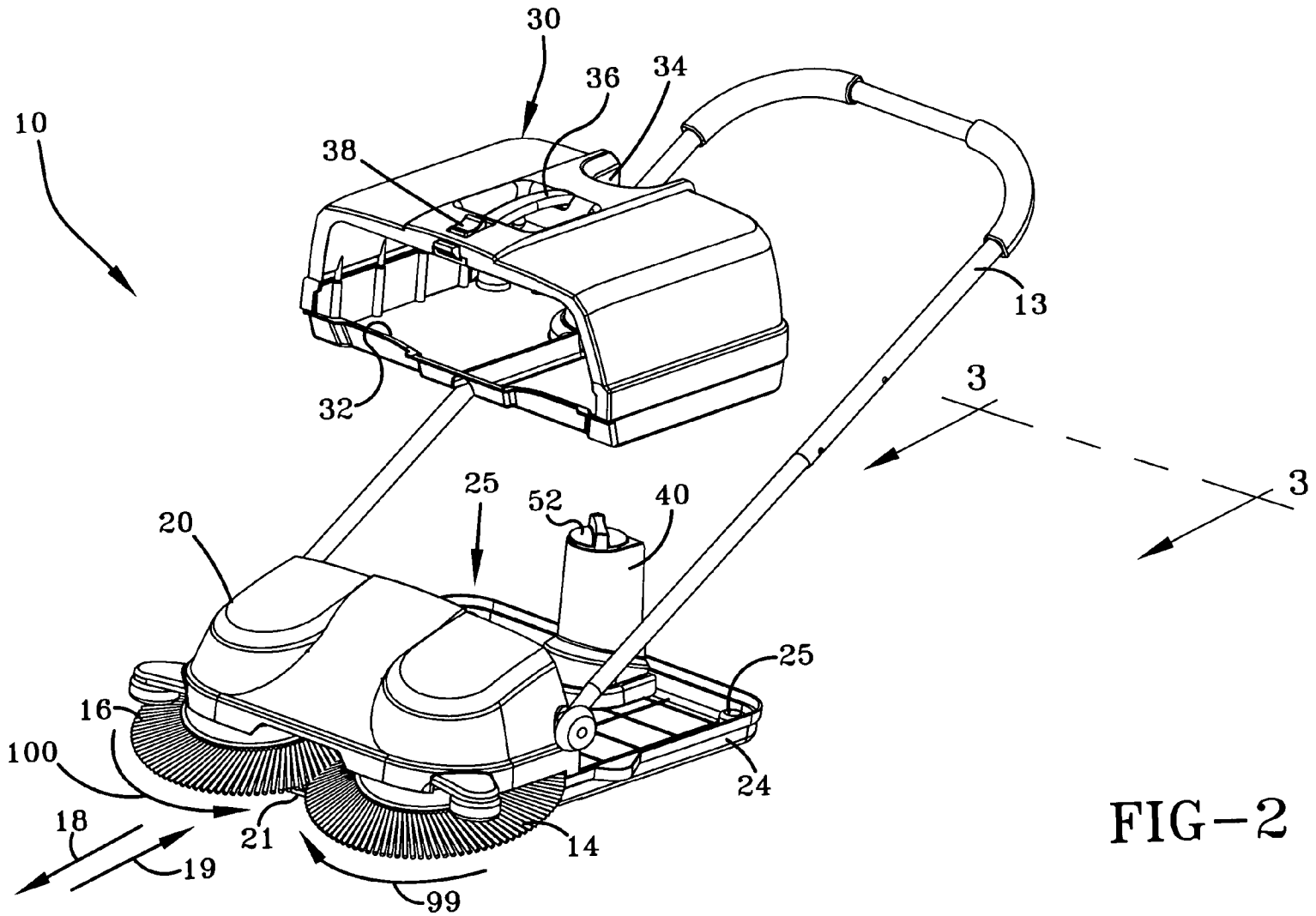
FIG. 2 is a perspective view similar to FIG. 1, but showing a dirt receptacle removed from the sweeper.

Referring now to FIGS. 1 and 2, there is shown a mechanical sweeper 10 which incorporates the features of the present invention therein. The sweeper 10 includes a front housing 20. A handle 13 is pivotally secured to the front housing 20 such that an operator may urge the sweeper forward in the general direction of arrow 18 or rearward in the general direction of arrow 19. A left brush 14 and right brush 16 are rotatably mounted to the front housing 20. Each of the brushes 14, 16 include tangentially extending bristles adapted to engage a surface in front of the sweeper 10 at an oblique angle. A scoop 21 is positioned in a lower portion of the front housing 20 and is adapted to direct dirt and debris collected by the brushes from the surface to the rear of the front housing 20. The scoop 21 is positioned proximate to the point at which the bristles of the brush 14 contact the bristles of the brush 16.

The drive mechanism is a worm gear arrangement similar to that described in U.S. Pat. No. 3,937,174. This drive mechanism drives the left brush 14 in the general direction of arrow 99 as the sweeper 10 is moved forward as indicated by arrow 18. Similarly, the drive mechanism drives the right brush 16 in the general direction of arrow 100 as the sweeper 10 is moved forward. The rotation of the left brush 14 in the general direction of arrow 99 cooperates with the rotation of the right brush 16 in the general direction of arrow 100 to advance debris on a surface in front of the sweeper 10 into the scoop 21 positioned beneath the sweeper 10. From the scoop 21, debris is advanced through the front housing 20 and into a removable dirt receptacle 30 via an opening 32 defined on the front portion of the dirt receptacle 30, see FIG. 2. It may be desirable to the operator of the sweeper 10 to include a transparent outer surface on at least a portion of the dirt receptacle 30 to allow the dirt and debris to be viewed as they are collected within the dirt receptacle 30.

This drive mechanism also drives the left brush 14 in the general direction of arrow 99 as the sweeper 10 is moved in reverse as indicated by arrow 19. Similarly, the drive mechanism drives the right brush 16 in the general direction of arrow 100 as the sweeper 10 is moved in reverse. The rotation of the left brush 14 in the general direction of arrow 99 cooperates with the rotation of the right brush 16 in the general direction of arrow 100 to advance debris on the surface in front of the sweeper 10 into the scoop 21. Thus, dirt and debris are advanced from the surface to the dirt receptacle 30 when the sweeper 10 is moved both in the forward direction, indicated by arrow 18, or the reverse direction, indicated by arrow 19.

A frame 24 is secured to the lower portion of the front housing 20 and extends rearwardly therefrom. The frame 24 is adapted to support a dirt receptacle 30 when the dirt receptacle 30 is positioned on the sweeper 10, as shown in FIG. 1. A height adjustment column 40 rises from the rear of the frame 24 and aids in orienting the dirt receptacle 30 relative to the frame 24 and front housing 20, see FIG. 2. To that end, the dirt receptacle 30 includes a notch 34 advantageously shaped to engage the column 40 and correctly orient the dirt receptacle 30 relative to the frame 24 and front housing 20. The frame 24 further includes a number of posts 25 which further aid in aligning the dirt receptacle 30 on the frame 24. To position the dirt receptacle 30 upon the frame 24, the notch 34 of the dirt receptacle is first positioned about the column 40, and the dirt receptacle 30 is lowered on to an upper surface of the frame 24. As the dirt receptacle 30 is lowered, the front of the dirt receptacle 30 is placed into an operational position whereby dirt and debris may be advanced from the scoop 21 to the interior of the dirt receptacle 30 via the opening 32.

Figure 3:
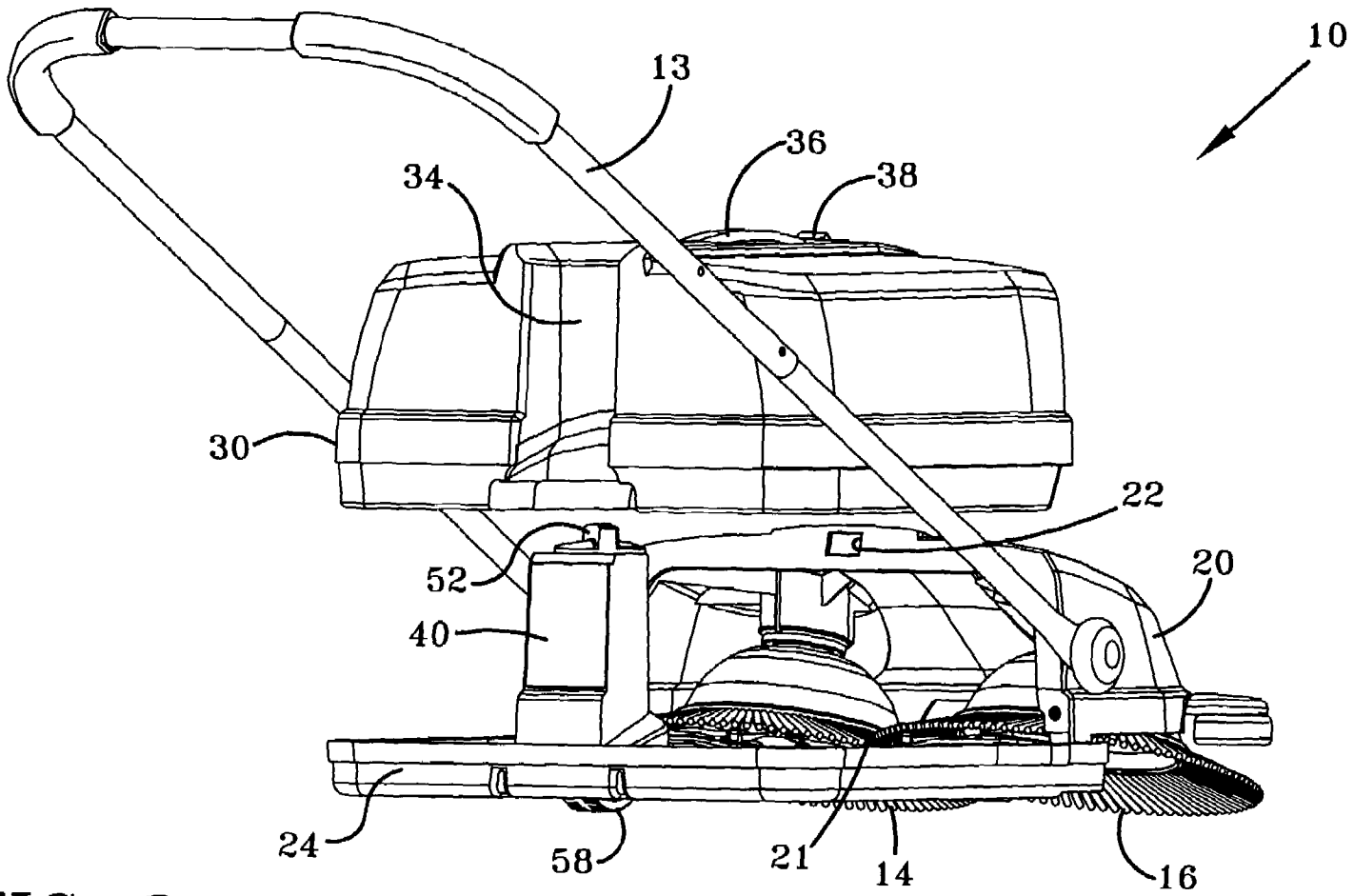
FIG. 3. is a perspective view of the mechanical sweeper of FIG. 2, taken along the line 3-3.

Referring now to FIGS. 2 and 3, the dirt receptacle 30 further includes a carry handle 36 defined in an upper surface of the dirt receptacle 30. A sliding latch 38 is positioned on the handle 36 such that the operator's thumb may be used to move the latch 38 in the general direction of arrow 19. The latch 38 is spring biased in the general direction of arrow 18. When the dirt receptacle 30 is positioned on the frame 24, as shown in FIG. 1, the biasing force urges the latch 38 into engagement with a catch 22 defined in an upper portion of the front housing 20, see FIG. 3. Engaging the sliding latch 38 to the catch 22 locks the dirt receptacle 30 to the front housing 20. To remove the dirt receptacle 30 from the front housing 20, the operator urges the sliding latch 38 in the general direction of arrow 19, thereby overcoming the biasing force of the spring which disengages the sliding latch 38 from the catch 22. Disengaging the sliding latch 38 from the catch 22 unlocks the dirt receptacle 30 from the front housing 20 and allows the operator to remove the dirt receptacle 30 from the sweeper 10. Dirt and debris collected within the dirt receptacle 30 may then be disposed by the operator.

Figure 4:
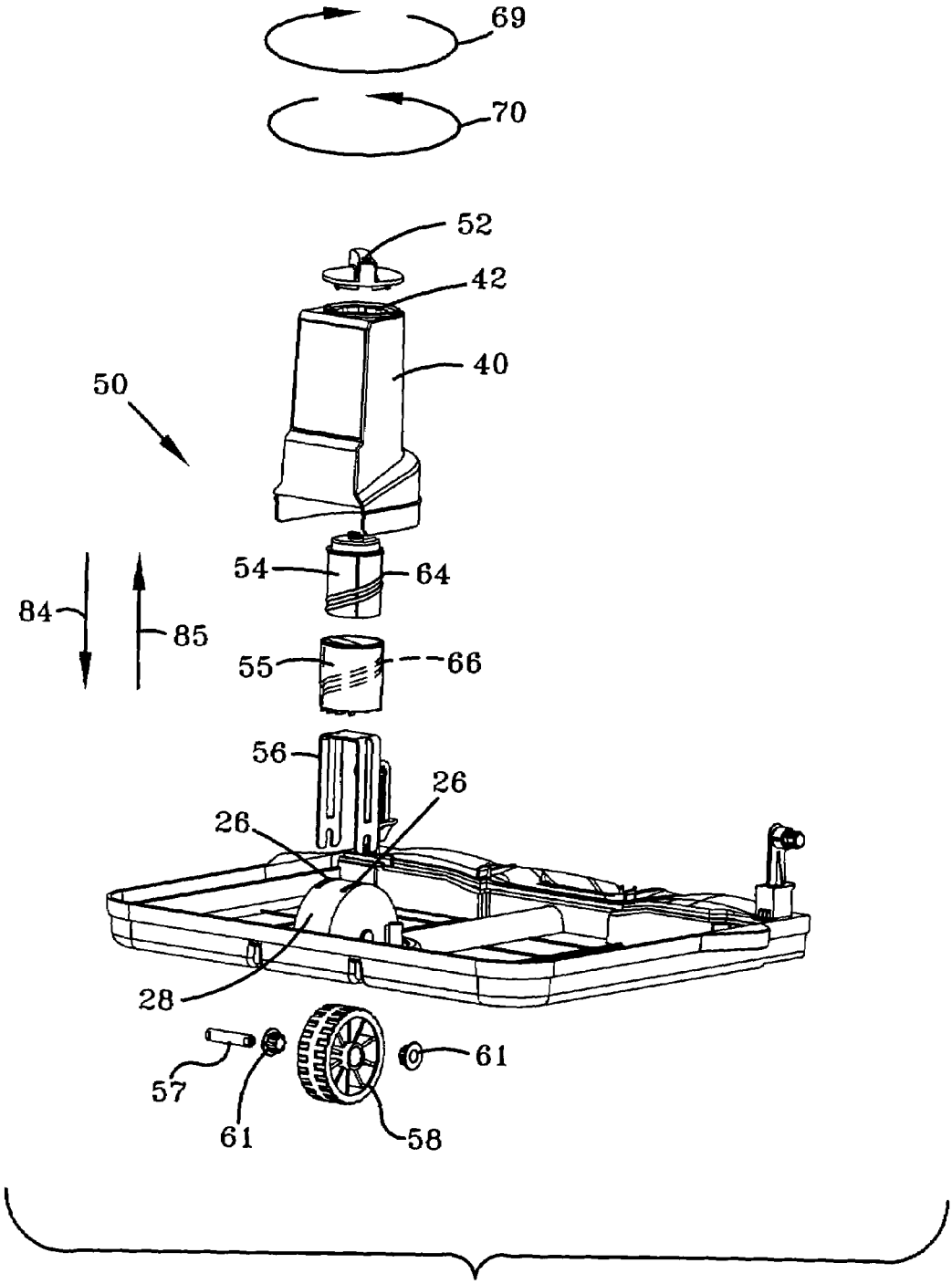
FIG. 4. is an exploded view of the height adjustment column and adjustable rear wheel of FIG. 3.

Referring now to FIG. 4, there is shown an exploded view of the column 40. An adjustable wheel assembly 50 is positioned within the column 40. The wheel assembly 50 includes, knob 52, screw 54, cam 55, axel support 56, axel 57, and wheel 58. To assemble the adjustable wheel assembly 50, the ends of the axel support 56 are first inserted through holes 26 defined in a wheel well 28 of the frame 24. The wheel 58 is then rotatably secured to the axel support 56 by the axel 57 and end caps 61. The upper end of the axel support 56 is then secured to the cam 55. The cam 55 includes helical threads 66 defined on an inner surface thereof. The screw 54, which has threads 64 defined on an outer surfaces thereof, is then placed into helical contact with the cam 55 by threading the outer threads 64 of the screw into the inner threads 66 of the cam 55. The column 40 is then placed about the screw 54, cam 55 and axel support 56 and is secured to the frame 24 above the wheel well 28. The adjustment knob 52 is then secured to the screw 54 via an opening 42 defined in the upper surface of the column 40 to complete the assembly of the adjustable wheel assembly 50.

Once assembled, it should be appreciated that the positioning the knob on top of the column allows for easy adjustment of the height of the wheel 58 by the operator. Rotating the knob 52 in the general direction of arrow 69 causes the threads 64 of the screw 54 to advance within the threads 66 of the cam 55 thereby moving the cam 55 and axel support 56 downwardly in the general direction of arrow 84 relative to the frame 24. It should be appreciated that moving the axel support 56 downwardly in the general direction of arrow 84 also causes the wheel 58 to move downwardly within the wheel well 28. Alternately, rotating the knob 52 in the general direction of arrow 70 causes the threads 64 of the screw 54 to retreat within the threads 66 of the cam 55 thereby moving the cam 55 and axel support 56 upwardly in the general direction of arrow 85 relative to the frame 24. It should be appreciated that moving the axel support 56 upwardly in the general direction of arrow 85 also causes the wheel 58 to move upwardly within the wheel well 28.

Figure 5:
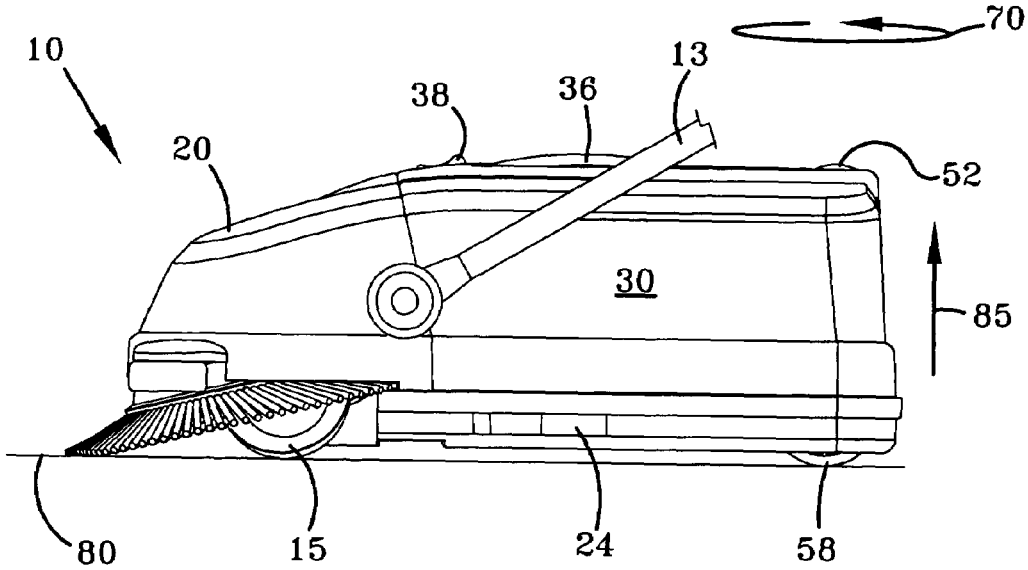
FIG. 5 is a side view of the sweeper of FIG. 1, showing the rear wheel in a raised position.

Referring now to FIG. 5, there is shown the effect of the adjustable height wheel 58 on the operation of the front brushes, 14, 16. As the adjustment knob 52 is rotated in the general direction of arrow 70, the rear wheel 58 is moved upwardly relative to the frame 24. Moving the wheel 58 upwardly, causes the sweeper 10 to pivot about the wheel 15 and reduces the amount of deflection of the brushes 14, 16 caused by engaging the surface 80, as shown in FIG. 5. As the brushes are elastic in nature, reducing the amount of deflection on the brushes 14, 16 reduces the force that the brushes 14, 16 apply to the surface 80. Setting the wheel 58 in this position is best for rough surfaces as it reduces the pushing effort required to move the sweeper 10.

Figure 6:
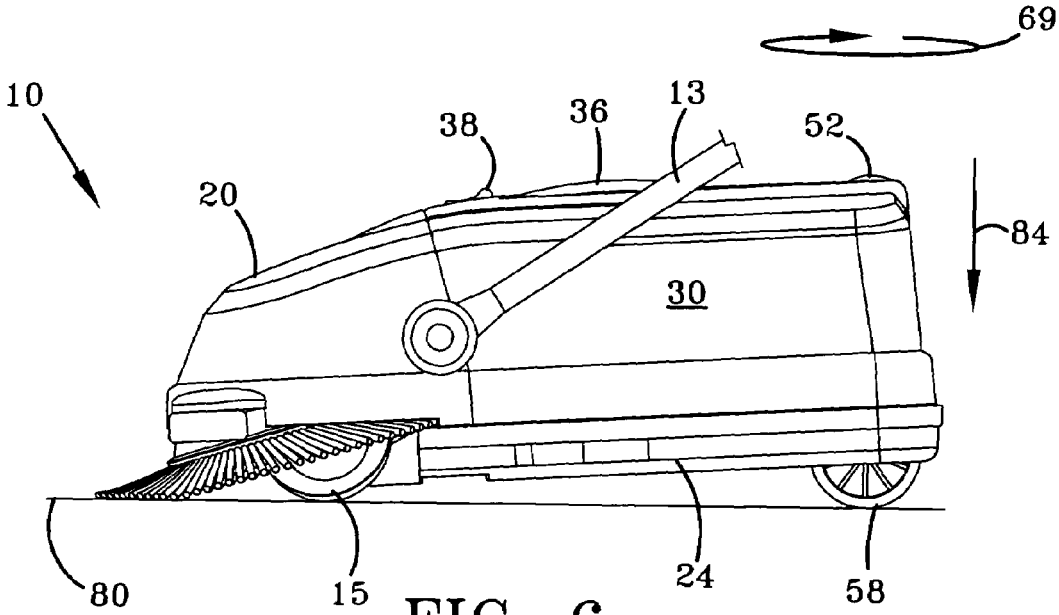
FIG. 6 is a view similar to FIG. 5, but showing the rear wheel in a lowered position.

Referring now to FIG. 6, as the adjustment knob 52 is rotated in the general direction of arrow 69, the rear wheel 58 is moved downwardly relative to the frame 24. Moving the wheel 58 downwardly, causes the sweeper 10 to pivot about the wheel 15 and increases the amount of deflection of the brushes 14, 16 caused by engaging the surface 80. As the brushes are elastic in nature, increasing the amount of deflection of the brushes increases the force that the brushes 14, 16 apply to the surface 80. Setting the wheel 58 in this position is best for smooth surfaces as it increases the cleaning effectiveness of the brushes.

While the invention has been illustrated and described in detail in the drawings and foregoing description, such illustration and description is to be considered as exemplary and not restrictive in character, it being understood that only the preferred embodiment has been shown and described and that all changes and modifications that come within the spirit of the invention are desired to be protected.

The invention claimed is:

1. A mechanical sweeper comprising:

a front housing;

a rotating brush secured to the front housing having tangentially extending bristles adapted to engage a surface at an oblique angle;

a frame having a first surface opposite a second surface, the first surface of the frame secured to a lower portion of the front housing;

a wheel well rising from and directly attached to the first surface of the frame;

a height adjustment column housing disposed over, and enclosing the wheel well, the column housing rising from and directly attached to the first surface of the frame;

a dirt receptacle removably attached on the first surface of the frame, wherein the front housing and column serve to orient the dirt receptacle in a position relative to the frame; and an adjustable wheel assembly positioned within the column housing.

2. The mechanical sweeper of claim 1, further comprising a notch defined in the rear of the dirt receptacle adapted to partially extend around the column.

3. The mechanical sweeper of claim 1, the adjustable wheel assembly further comprising a rotary knob on top of the column housing.

4. The mechanical sweeper of claim 3, further comprising a cam which moves the adjustment wheel up and down relative to the frame as the knob is rotated.

5. The mechanical sweeper of claim 1, wherein moving the adjustment wheel downwardly relative to the frame increases the force of the brush on the surface.

6. The mechanical sweeper of claim 1, wherein moving the adjustment wheel upwardly relative to the frame decreases the force of the brush on the surface.

7. The mechanical sweeper of claim 1, further comprising a latch positioned on the upper portion of the dirt receptacle.

8. The mechanical sweeper of claim 7, wherein the latch, column and frame cooperate to position the dirt receptacle relative to the front housing.

9. The mechanical sweeper of claim 7, wherein the latch moves in a linear path to engage a catch defined in the upper portion of the front housing.

10. A mechanical sweeper comprising:

a front housing;

a first and a second rotating brush secured to the front housing each having tangentially extending bristles adapted to engage a surface at an oblique angle;

a dirt scoop positioned in the upper housing proximate to the point at which the bristles of the first brush contact the bristles of the second brush;

a frame having a first surface and a second surface, the first surface of the frame secured to a lower portion of the front housing;

a wheel well located toward the rear of the frame, and said wheel well rising from the first surface of the frame;

a column housing disposed over, and enclosing the wheel well, the column rising from and directly attached to the first surface of the frame;

an adjustable wheel assembly positioned within the column housing; and a dirt receptacle removably attached on the first surface of the frame and adapted to receive dirt from the dirt scoop when placed in an operational position, wherein: the front housing and column serve to orient the dirt receptacle in the operational position.

11. The mechanical sweeper of claim 10, further comprising a notch defined in the rear of the dirt receptacle adapted to partially extend around the column housing.

12. The mechanical sweeper of claim 10, the adjustable wheel assembly further comprising a rotary knob on top of the column.

13. The mechanical sweeper of claim 12, further comprising a cam assembly which moves the adjustment wheel up and down relative to the frame as the knob is rotated.

14. The mechanical sweeper of claim 10, wherein:

moving the adjustment wheel downwardly relative to the frame increases the force of the first brush on the surface, and moving the adjustment wheel downwardly relative to the frame increases the force of the second brush on the surface.

15. The mechanical sweeper of claim 10, wherein:

moving the adjustment wheel upwardly relative to the frame decreases the force of the first brush on the surface, and moving the adjustment wheel upwardly relative to the frame decreases the force of the second brush on the surface.

16. The mechanical sweeper of claim 10, further comprising a latch positioned on the upper portion of the dirt receptacle.

17. The mechanical sweeper of claim 16, wherein the latch, column and frame cooperate to position the dirt receptacle relative to the scoop.

18. The mechanical sweeper of claim 16, wherein the latch moves in a linear path to engage a catch defined in the upper portion above the scoop.

19. A mechanical sweeper comprising:

a front housing;

a rotating brush secured to the front housing;

a frame having a first surface opposite a second surface, the first surface of the frame secured to a lower portion of the front housing and extending rearwardly therefrom;

a wheel well defined by said frame;

a height adjustment column housing disposed over, and enclosing said wheel well, said column housing rising from and directly attached to the first surface of said frame;

a dirt receptacle releasably attached to said frame; and an adjustable wheel assembly at least partially receivable within said column housing and movable vertically to adjust the height of said frame, wherein said adjustable wheel assembly at least partially supports said frame when said dirt receptacle is removed, said wheel well at least partially receiving a wheel maintained by said adjustable wheel assembly.

20. The mechanical sweeper of claim 19, wherein said dirt receptacle defines a notch for at least partially receiving said column, wherein said column is engageable with said notch to orient said dirt receptacle relative to said frame.

* * * * *